US010604329B2

(12) United States Patent
Strand

(10) Patent No.: US 10,604,329 B2
(45) Date of Patent: Mar. 31, 2020

(54) APPARATUS FOR MEDICATION MANAGEMENT

(71) Applicant: Gary Strand, Derwood, MD (US)

(72) Inventor: Gary Strand, Derwood, MD (US)

( * ) Notice: Subject to any disclaimer, the term of this patent is extended or adjusted under 35 U.S.C. 154(b) by 34 days.

(21) Appl. No.: 16/104,125

(22) Filed: Aug. 16, 2018

(65) Prior Publication Data

US 2019/0055078 A1 Feb. 21, 2019

Related U.S. Application Data

(60) Provisional application No. 62/547,453, filed on Aug. 18, 2017.

(51) Int. Cl.

| | |
|---|---|
| ***B65D 83/04*** | (2006.01) |
| ***A61J 7/02*** | (2006.01) |
| ***A61J 1/03*** | (2006.01) |

(52) U.S. Cl.

CPC ..... *B65D 83/04* (2013.01); *A61J 1/03* (2013.01); *A61J 7/02* (2013.01)

(58) Field of Classification Search

CPC ..... A61J 2200/74; A61J 2205/30; A61J 1/03; A61J 7/02; G01G 19/00; G01G 19/42; B65D 83/04

See application file for complete search history.

(56) References Cited

U.S. PATENT DOCUMENTS

| | | | | |
|---|---|---|---|---|
| 2,502,311 A | | 8/1945 | Clarke | |
| 2,530,009 A | * | 11/1950 | Fields | A61J 7/02 222/129 |
| 2,536,127 A | * | 1/1951 | De Philip | A61J 7/02 414/675 |
| 3,255,894 A | * | 6/1966 | Van Handel | A61J 7/02 414/675 |
| 3,819,064 A | * | 6/1974 | Chandler | A61J 7/02 414/675 |
| 4,245,742 A | | 1/1981 | Rossmo | |
| 5,275,291 A | * | 1/1994 | Sledge | B65D 43/20 206/1.5 |
| 5,344,024 A | | 9/1994 | Cohu | |
| 6,168,046 B1 | * | 1/2001 | Galesi | A61J 7/0084 221/106 |
| 6,196,426 B1 | * | 3/2001 | White | A61J 7/02 222/462 |
| 6,457,611 B1 | | 10/2002 | Koehler | |
| 6,811,054 B1 | * | 11/2004 | Moest | A61J 7/0023 221/25 |
| 7,007,838 B1 | * | 3/2006 | Bostick, II | B65D 5/008 229/189 |
| 8,066,124 B2 | * | 11/2011 | Koh | A61J 7/02 206/518 |

(Continued)

*Primary Examiner* — Gene O Crawford
*Assistant Examiner* — Ayodeji T Ojofeitimi
(74) *Attorney, Agent, or Firm* — Charles Runyan

(57) ABSTRACT

An apparatus for sorting, managing, and storing a plurality of pills which provides a means to get pills from pharmacy bottles into weekly containers (that are common in the market place) without needing to pick up each individual pill. The sorting/dispensing tray may come with weekly pill containers (breakfast, lunch, dinner, and bedtime) and be designed to snap into the base tray for pill management. Keeping the pill containers free from the base tray may enable them to be easily transported in a purse or pants pocket if traveling for the day.

20 Claims, 5 Drawing Sheets

(56) References Cited

U.S. PATENT DOCUMENTS

| | | | | |
|---|---|---|---|---|
| 10,369,076 | B2 * | 8/2019 | Milante | A61J 1/035 |
| 2006/0283766 | A1 * | 12/2006 | Koh | A61J 7/02 206/557 |
| 2009/0065383 | A1 * | 3/2009 | Schardt | B65D 43/20 206/267 |
| 2009/0206100 | A1 | 8/2009 | Mazur | |
| 2009/0285663 | A1 * | 11/2009 | Chemel | A61J 7/02 414/675 |
| 2010/0155411 | A1 | 6/2010 | Solari et al. | |
| 2010/0192979 | A1 * | 8/2010 | Fay | A61J 7/02 134/21 |
| 2013/0302123 | A1 * | 11/2013 | Connellan | A61J 7/02 414/675 |
| 2014/0093344 | A1 * | 4/2014 | Burton | A61J 7/02 414/675 |
| 2014/0237730 | A1 * | 8/2014 | Connellan | B67B 7/44 7/151 |
| 2014/0263389 | A1 * | 9/2014 | Perozek | A61J 7/02 221/1 |
| 2016/0000656 | A1 * | 1/2016 | Devita | A61J 7/02 222/156 |
| 2018/0125760 | A1 * | 5/2018 | Chessa | A61J 7/02 |
| 2019/0201292 | A1 * | 7/2019 | Krezanoski | A61J 1/03 |

* cited by examiner

APPARATUS FOR MEDICATION MANAGEMENT

CROSS REFERENCE TO RELATED APPLICATION

The present application is related to and claims priority to U.S. Provisional Patent Application No. 62/547,453 filed Aug. 18, 2017, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of special receptacles or packages and more specifically relates to compartmented receptacles.

2. Description of Related Art

People who take prescription medications often obtain their medicine in a small bottle/container filled by a pharmacy. Individuals with limited physical dexterity may have trouble picking out a specific number of pills from the bottle. Some medications must be taken on a daily basis and having to dig pills out of a bottle every day can be frustrating. Pills come in different sizes and shapes and can easily roll off tables or slip out of fingers and once a pill lands on the floor, it is often hard to find making it a potential hazard to animals and small children. A suitable solution is desired.

U.S. Pub. No. 2009/0206100 to Robert Mazur relates to an eazy load pillbox and loading tray. The described eazy load pillbox and loading tray includes modular pillboxes that include at least one one-way passage through which pills, materials or other articles can be pushed through and into and underlying interior compartment of the modular pillboxes. The modular pillboxes include coupling structure by which the modular pillbox can be coupled to a loading tray and/or additional modular pillboxes. The modular pillboxes include lids that can be opened to access pills, materials or other articles that are loaded therein through the one-way passages.

BRIEF SUMMARY OF THE INVENTION

In view of the foregoing disadvantages inherent in the known special receptacles or packages art, the present disclosure provides a novel apparatus for medication management. The general purpose of the present disclosure, which will be described subsequently in greater detail, is to provide a means to get pills from pharmacy bottles into weekly containers without needing to pick up each individual pill.

An apparatus for sorting, managing, and storing a plurality of pills is disclosed herein. The apparatus includes a first sorting tray, a second sorting tray, a plurality of pill passageways, at least one pillbox, and a pill insertion tool. The first sorting tray is configured for holding one or more of the plurality of pills, the first sorting tray includes a first tray surface defining a first holding direction that may be normal to the first tray surface, a first tray rim extending from the first tray surface in the first holding direction, and a first pill exit defined by a break in the first tray rim proximate the first tray surface, the first pill exit sized and dimensioned to permit at least one of the plurality of pills to be slid off the first tray surface when the first direction may be oriented upward. The second sorting tray is configured for holding one or more of the plurality of pills, the second sorting tray is coupled to the first sorting tray, the second sorting tray includes a second tray surface defining a second holding direction that is normal to the second tray surface and is opposite the first holding direction, a second tray rim extending from the second tray surface in the second holding direction and, a second pill exit defined by a break in the second tray rim proximate the second tray surface, the second pill exit is sized and dimensioned to permit at least one of the plurality of pills to be slid off the second tray surface when the second direction may be oriented upward. Each pill passageway passes through the first sorting tray surface and the second sorting tray surface and is configured to permit passage of one of the plurality of pills between the first sorting tray surface and the second sorting tray surface. The base tray comprises one unit that has a tray on each side. Once the pill container is snapped into the base tray on one side the user can put pills into the container or by flipping the tray over, he/she can retrieve their daily pills.

The at least one pillbox is configured to removably couple to the first sorting tray, and further configured to segregate and store the plurality of pills; the at least one pillbox includes a plurality of individual storage units coupled together, each individual storage unit may include a pill chamber, sized and dimensioned to hold at least one of the plurality of pills, the pill chamber having a chamber opening sized and dimensioned to provide a user with access to the pill chamber, a chamber lid coupled to the pill chamber and configured to close the chamber opening of the pill chamber, the chamber lid sharing a snap-fit interface with the pill chamber, and a pill port configured to align with one of the plurality of pill passageways when the pillbox may be coupled to the first sorting tray, and further configured to individually receive one of the plurality of pills into the pill chamber via its respectively aligned pill passageway when inserted by the user, and to retain the one of the plurality of pills from exiting the pill chamber once inserted. The pill insertion tool is configured to be held by the user, and further configured to both maneuver one of the plurality of pills by the user and insert the one of the plurality of pills into the one of the plurality of individual storage units via its respective pill port. The pill insertion tool includes an elongate member, a user interface at one end of the elongate member, and a pill interface at an opposite end of the elongate member; the pill interface is sized and dimensioned to receive and hold at least a portion of the one of the plurality of pills during insertion into the one of the plurality of individual storage units via its respective pill port.

A method of using the apparatus for sorting, managing, and storing a plurality of pills is also disclosed herein. The method of using the apparatus for sorting, managing, and storing a plurality of pills may comprise the steps of: providing the apparatus for sorting, managing, and storing a plurality of pills described above, attaching one of the at least one pillbox to the second sorting tray; turning the apparatus for sorting, managing, and storing the plurality of pills so that the first sorting tray may be facing upward; pouring the plurality of pills onto the first sorting tray; gripping the pill insertion tool by the user interface so that the pill interface may be in a distal orientation; and pushing each of the plurality of pills individually into and through one of the plurality of pill passageways and into one of the plurality of individual storage units of the at least one pillbox For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, an apparatus for medication management, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to a special receptacles or packages and more particularly to an apparatus for medication management as used to improve the means for dispensing of medication in an efficient way.

Generally, many people take medication on a regular basis to maintain control over certain conditions/illnesses such as diabetes, high cholesterol, high blood pressure, pain medication, etc. Timing and regularity are critical to managing these conditions while maintaining the effectiveness of the medications. For example, some diabetes medicines must be taken in exactly twelve-hour intervals to maintain the proper blood sugar level. This pill organizer provides a means to get their pills from the pharmacy bottles into weekly containers that are common in the market place without needing to pick up each individual pill.

The sorting/dispensing tray will come with weekly pill containers (breakfast, lunch, dinner and bedtime) designed to snap into the base tray for pill management. Keeping the pill containers free from the base tray enables them to be easily transported in a purse or pants pocket if traveling for the day. Once a weekly pill container is snapped into the tray, the pills from the pharmacy bottle would be poured into the top tray surface. Using a finger or the included stylus tool, the user can simply slide and push the pills through a one-way port dropping them into the appropriate daily chambers of the weekly pill container. One corner of the tray is cut to form a spout so that the excess pills can then be poured back into the pharmacy bottle for future use.

To retrieve the pills the user simply flips the tray over, opens the desired chamber, and pours the pills out onto the tray. The pills can then be poured into a small dispensing cup from another corner spout. This invention allows those with limited physical dexterity to manage and obtain their own daily medication without having to ask for assistance or even touch a pill. This disclosure may provide an easy way to keep track of daily medication requirements.

Figure 1:
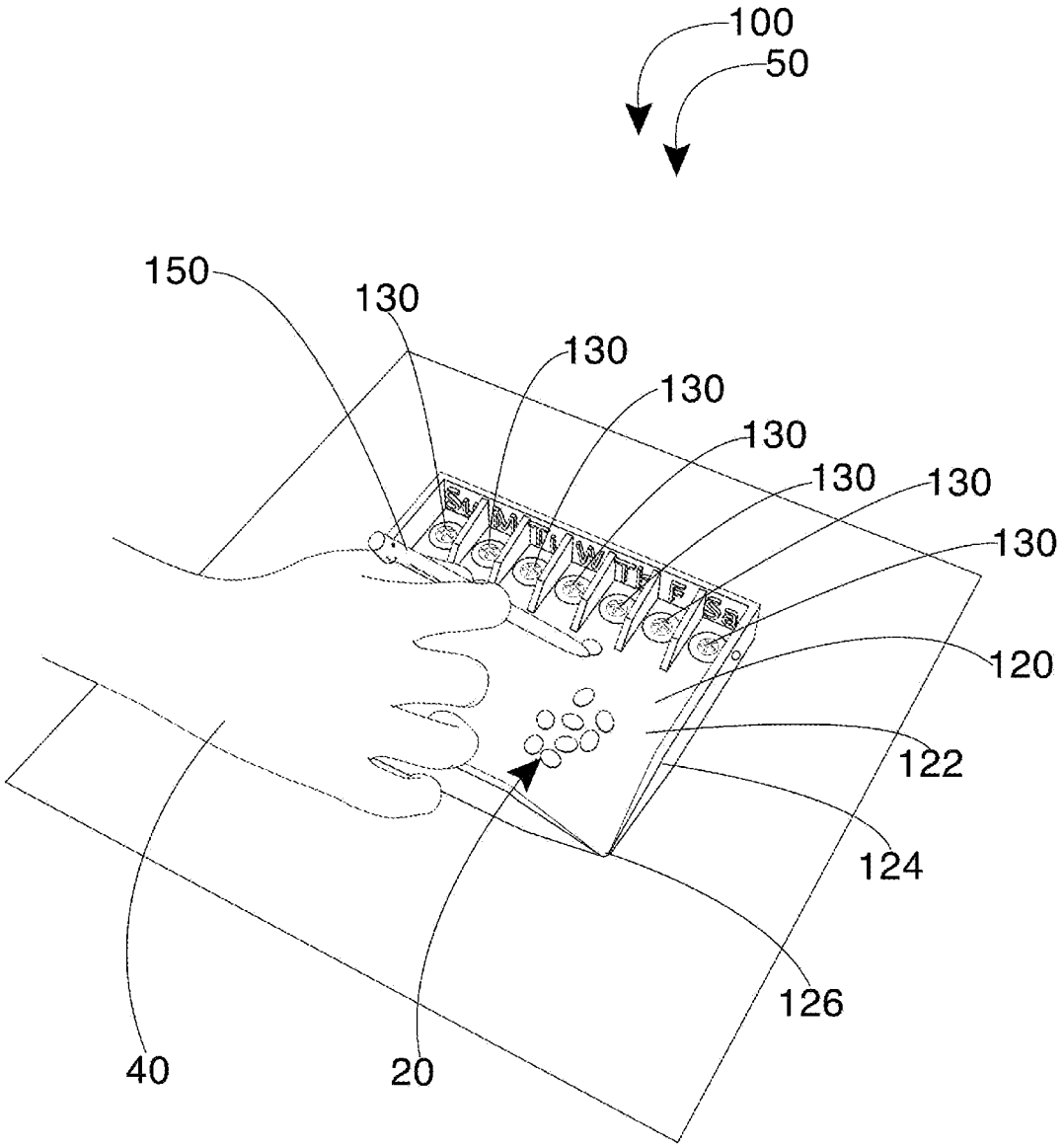
FIG. 1 is a perspective view of the apparatus for sorting, managing, and storing a plurality of pills during an 'in-use' condition, according to an embodiment of the disclosure.

Referring now more specifically to the drawings by numerals of reference, there is shown in FIGS. 1-4, various views of an apparatus for sorting, managing, and storing a plurality of pills 100. FIG. 1 shows an apparatus 100 for sorting, managing, and storing a plurality of pills during an 'in-use' condition 50 by a user 40, according to an embodiment of the present disclosure. The apparatus 100 has a first side and a second side, with the second side illustrated here.

The apparatus 100 for sorting, managing, and storing a plurality of pills may include a first sorting tray 110 (FIG. 3), a second sorting tray 120, a plurality of pill passageways 130, at least one pillbox 140 (FIG. 3), a pill insertion tool 150. The second sorting tray 120 is configured for holding one or more of a plurality of pills 20 and includes a second surface 122, a second tray rim 124 extending from the second tray surface 122, and a second pill exit 126 defined by a break in the second tray rim 124 and dimensioned to allow one or more pills to be slid off the second tray surface 122 when the apparatus 100 is appropriately tipped or turned.

A plurality of pills 20 may be in the form of a capsule, tablet, gel tab, or gel cap and may be poured from a bottle or other container onto the second tray surface 122. Once on the second sorting tray 120 the user 40 can hold the pill insertion tool 150 and use it to manipulate the pills. The pill insertion tool 150 is configured to be held by the user 40 and includes an elongate member with a user interface and a pill interface. The pill interface is configured to allow for the user 40 to maneuver one of the pills 20 toward one of the plurality of pill passageways 130. The pill interface may include a concave section, may be formed of a friction-gripping material such as rubber or similar materials, or a combination of these. Each of the plurality of pill passageways 130 allow a pill to be pushed through from either the first sorting tray surface 112 or the second sorting tray surface 122 through to the opposite side.

Once a pill has been maneuvered to one of the plurality of pill passageways 130, the user can use the pill insertion tool 150 to push the pill through the one of the plurality of pill passageways 130 and into the corresponding one of a plurality of individual storage units 142 (FIG. 3) of the at least one pillbox 140. The at least one pillbox 140 may be attached on the opposite side of the apparatus 100.

Once the user 40 has pushed all the needed pills through the plurality of pill passageways 130 as needed, he/she can pour any pills 20 remaining on the second tray surface 122, through the second pill exit 126 and back into the bottle or other container by tilting or tipping the apparatus 100 appropriately.

The pill insertion tool 150 may have a circular circumference about a longitudinal axis of the elongate member, or alternatively may have a polygonal circumference about the longitudinal axis of the elongate member.

Figure 2:
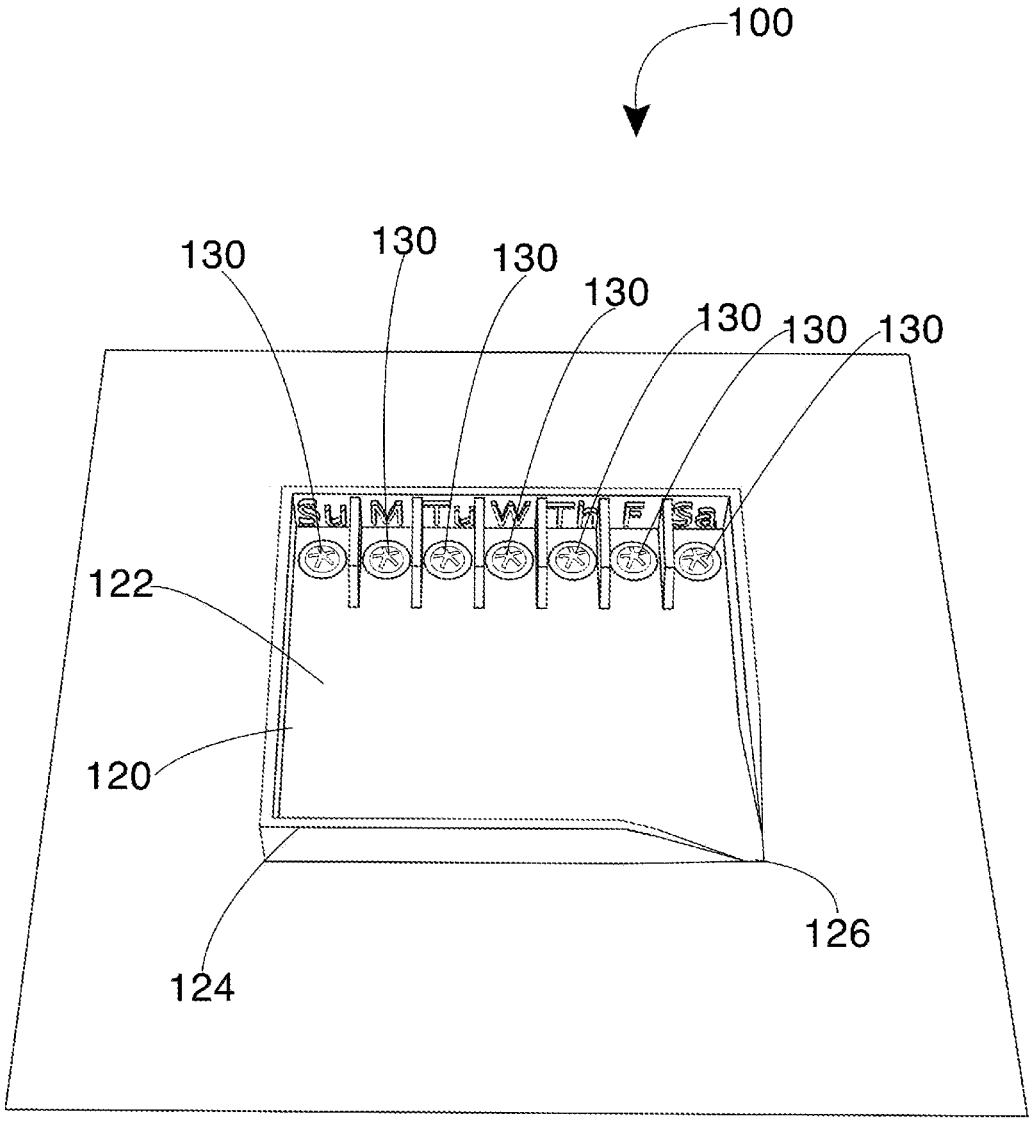
FIG. 2 is a perspective view of the apparatus for sorting, managing, and storing a plurality of pills of FIG. 1, according to an embodiment of the present disclosure.

FIG. 2 shows a perspective view of the apparatus for sorting, managing, and storing a plurality of pills 100 of FIG. 1, according to an embodiment of the present disclosure. Here, the second side is shown. As above, the apparatus for sorting, managing, and storing a plurality of pills 100 may include a second sorting tray 120 and a plurality of pill passageways 130. The second sorting tray 120 is configured for holding one or more of a plurality of pills 20 and includes a second surface 122, a second tray rim 124 extending from the second tray surface 122, and a second pill exit 126 defined by a break in the second tray rim 124 and dimensioned to allow one or more pills to be slid off the second tray surface 122 when the apparatus 100 is appropriately tipped or turned.

Figure 3:
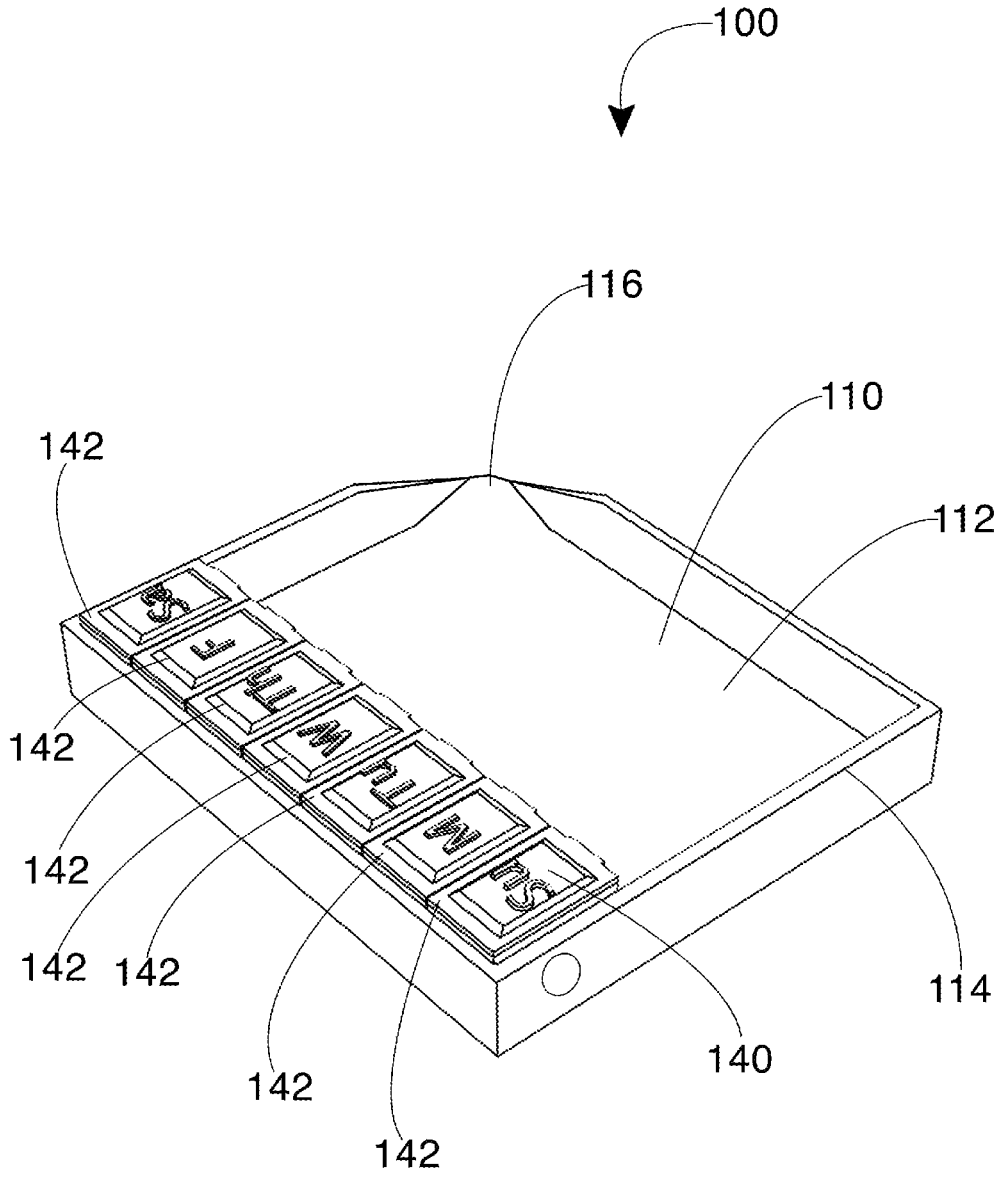
FIG. 3 is a perspective view of the apparatus for sorting, managing, and storing a plurality of pills of FIG. 1, according to an embodiment of the present disclosure.

Referring now to FIG. 3 showing a perspective view of the apparatus 100 for sorting, managing, and storing a plurality of pills of FIG. 1, according to an embodiment of the present disclosure. As above, the apparatus 100 may include a first sorting tray 110. The first sorting tray 110 is configured for holding one of more of a plurality of pills 20 and includes a first surface 112, a first tray rim 114 extending from the first tray surface 112, and a first pill exit 116 defined by a break in the first tray rim 114 and dimensioned to allow one or more pills to be slid off the first tray surface 112 when the apparatus 100 is appropriately tipped or turned.

As shown, the apparatus 100 also includes the at least one pillbox 140. The at least one pillbox 140 is removably coupleable to the first sorting tray 110 and can segregate and store the plurality of pills within a plurality of individual storage units 142. The at least one pillbox 140 is able to be properly inserted and aligned as well as removably secured to the first sorting tray 110 by means of a press-fit or friction-fit but may also be secured in alternative means in other embodiments.

Each of the plurality of individual storage units 142 include a pill chamber which is sized and dimensioned to provide a user with access to the pill chamber. Each of the plurality of individual storage units 142 also includes a chamber lid which can be opened and closed, and a pill port. The pill port is configured to align with one of the plurality of pill passageways 130 when the at least one pillbox 140 is coupled to the first sorting tray 110. In this coupled state, the pill port can receive one of the plurality of pills 20 into the pill chamber via its respectively aligned pill passageway 130 when inserted by a user. The pill port will also retain any pills that have been inserted into the pill chamber.

The first sorting tray 110, second sorting tray 120, the plurality of pill passageways 130, the at least one pillbox 140, and the pill insertion tool 150 may be made of plastic, ferrous material, nonferrous material, wood, glass, or any combination of these. The at least one pillbox 140 may include indicia to indicate a time of day such as morning, AM, mid-morning, mid-day, noon, lunch, mid-afternoon, afternoon, late-afternoon, dinner, evening, nighttime, bedtime, or PM. The included indicia may alternatively include a time of a clock. Additionally, each chamber lid may be labeled to indicate a day of a week, and each of the plurality of pill passageways 130 may be labeled to indicate a day of the week corresponding with the day of the week of its respective chamber lid. The at least one pillbox 140 may be at least semitransparent, whereas the first sorting tray 110 and second sorting tray 120 may be opaque.

Figure 4:
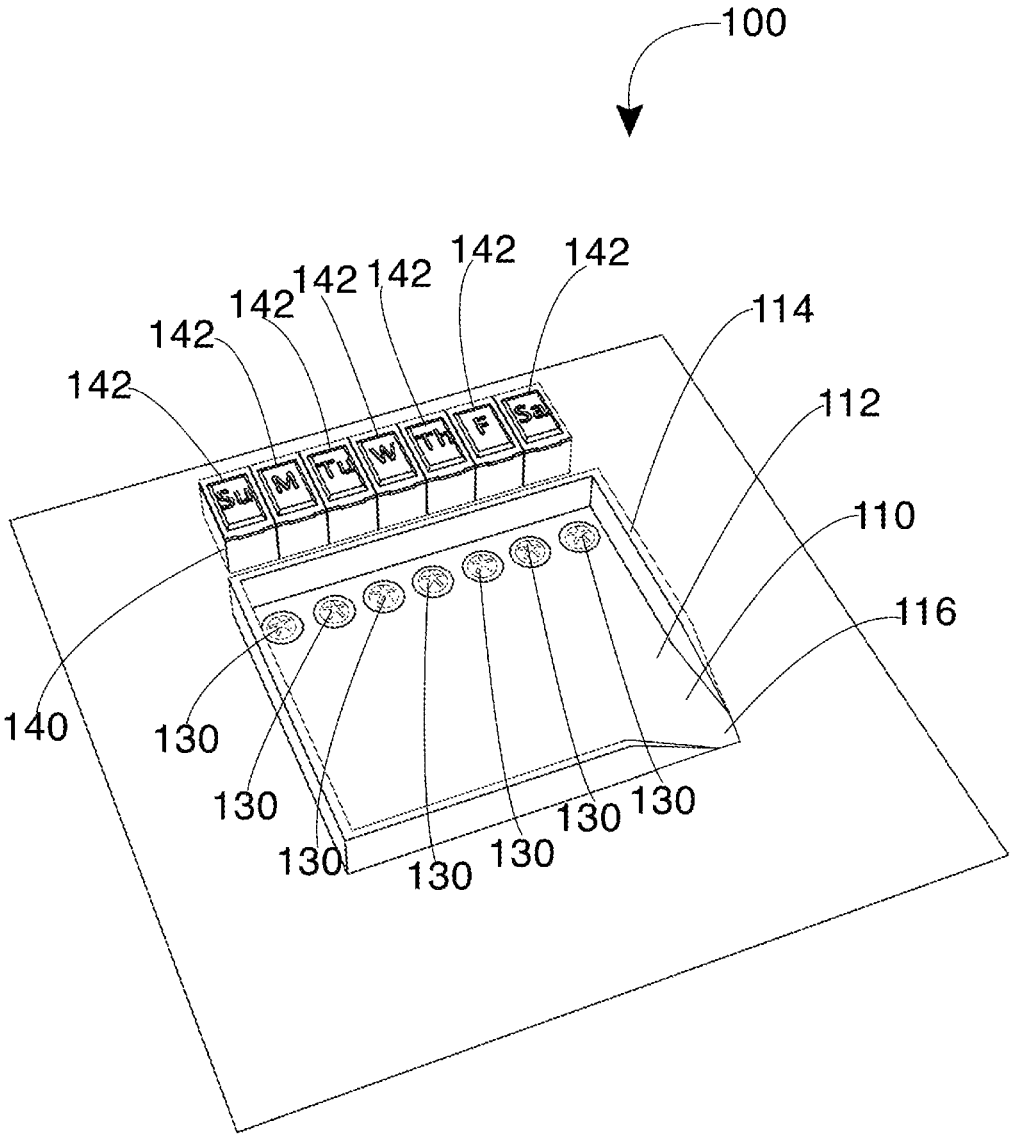
FIG. 4 is a perspective view of the apparatus for sorting, managing, and storing a plurality of pills of FIG. 1, according to an embodiment of the present disclosure.

FIG. 4 shows a perspective view of the apparatus for sorting, managing, and storing a plurality of pills 100 of FIG. 1, according to an embodiment of the present disclosure. As above, the apparatus for sorting, managing, and storing a plurality of pills 100 may include a first sorting tray 110, a plurality of pill passageways 130, and an at least one pillbox 140. Each pill port of the at least one pillbox 140 is configured to 'automatically' close when one of the plurality of pills 20 is not being inserted by the user.

Figure 5:
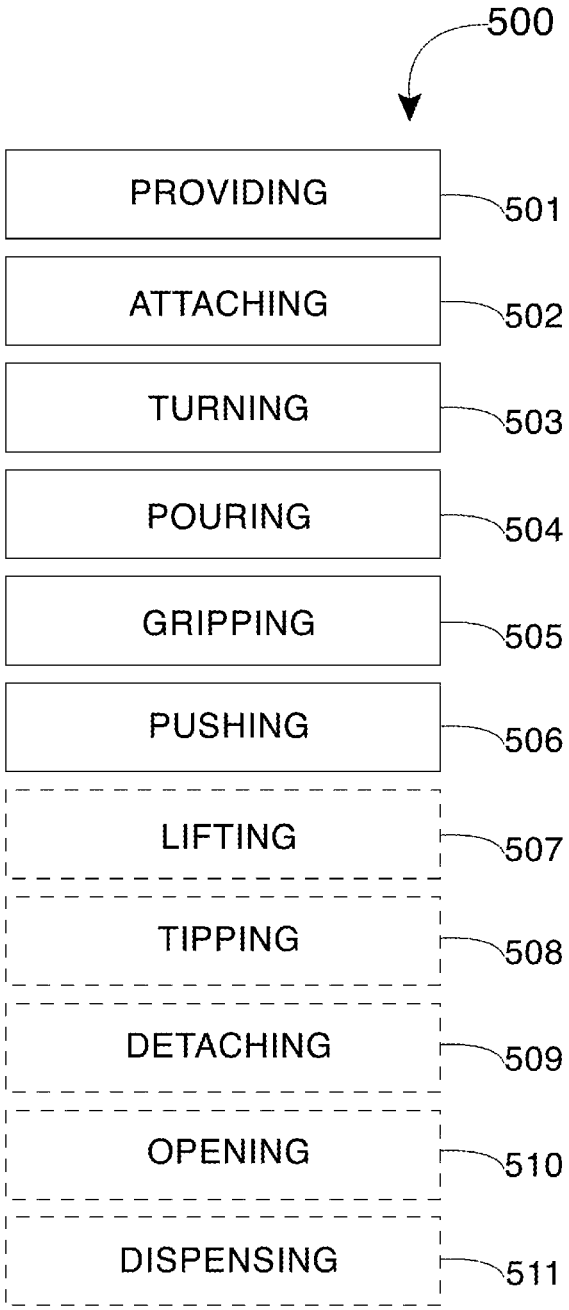
FIG. 5 is a flow diagram illustrating a method of use for the apparatus for sorting, managing, and storing a plurality of pills, according to an embodiment of the present disclosure.

Referring now to FIG. 5 showing a flow diagram 550 illustrating a method 500 of sorting, managing, and storing a plurality of pills, according to an embodiment of the present disclosure. As illustrated, the method 500 of sorting, managing, and storing a plurality of pills, may include the steps of: providing 501 an apparatus for sorting, managing, and storing a plurality of pills 100 as described herein; attaching 502 one of an at least one pillbox 140 to the second sorting tray 120; turning 503 the apparatus for sorting, managing, and storing a plurality of pills 100 so that the first sorting tray 110 may be facing upward; pouring 504 the plurality of pills 20 onto the first sorting tray 110; gripping 505 the pill insertion tool 150 by the user interface so that the pill interface may be in a distal orientation; and pushing 506 each of the plurality of pills 20 individually into and through one of the plurality of pill passageways 130 and into one of the plurality of individual storage units 142 of the at least one pillbox 140. The method 500 may further comprise the steps of: lifting 507 the apparatus for sorting, managing, and storing a plurality of pills 100; and tipping 508 the apparatus for sorting, managing, and storing a plurality of pills 100 so that the remaining pills are poured through the first pill exit 116. The method 500 may yet further comprise the steps of: detaching 509 the at least one pillbox 140 from the second sorting tray 120; opening 510 a chamber lid of the pillbox 140; and dispensing 511 the contents of the opened one of the plurality of individual storage units 142.

It should be noted that steps 507-511 are optional steps and may not be implemented in all cases. Optional steps of method of use 500 are illustrated using dotted lines in FIG. 5 so as to distinguish them from the other steps of method of use 500. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for the apparatus for sorting, managing, and storing a plurality of pills 100 (e.g., different step orders within above-mentioned list, elimination or addition of certain steps, including or excluding certain maintenance steps, etc.), are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. An apparatus for sorting, managing, and storing a plurality of pills, the apparatus comprising:

a first sorting tray, said first sorting tray configured for holding one or more of the plurality of pills, the first sorting tray including a first tray surface defining a first holding direction that is normal to the first tray surface, a first tray rim extending from the first tray surface in the first holding direction, and a first pill exit defined by a break in the first tray rim proximate the first tray surface, the first pill exit sized and dimensioned to permit at least one of the plurality of pills to be slid off the first tray surface when the first direction is oriented upward;

a second sorting tray, said second sorting tray configured for holding one or more of the plurality of pills, the second sorting tray coupled to the first sorting tray, the second sorting tray including a second tray surface defining a second holding direction that is normal to the second tray surface and is opposite the first holding direction, a second tray rim extending from the second tray surface in the second holding direction, and a second pill exit defined by a break in the second tray rim proximate the second tray surface, the second pill exit sized and dimensioned to permit at least one of the plurality of pills to be slid off the second tray surface when the second direction is oriented upward;

a plurality of pill passageways, each pill passageway passing through the first sorting tray surface and the second sorting tray surface, and configured to permit passage of one of the plurality of pills between the first sorting tray surface and the second sorting tray surface;

at least one pillbox, said at least one pillbox configured to removably couple to the first sorting tray, and further configured to segregate and store the plurality of pills, the at least one pillbox including a plurality of individual storage units coupled together, each individual storage unit including a pill chamber, sized and dimensioned to hold at least one of the plurality of pills, the pill chamber having a chamber opening sized and dimensioned to provide a user with access to the pill chamber, a chamber lid coupled to the pill chamber and configured to close the chamber opening of the pill chamber, said chamber lid sharing a snap-fit interface with the pill chamber, and a pill port configured to align with one of the plurality of pill passageways when the pillbox is coupled to the first sorting tray, and further configured to individually receive one of the plurality of pills into the pill chamber via its respectively aligned pill passageway when inserted by the user, and to retain said one of the plurality of pills from exiting the pill chamber once inserted; and a pill insertion tool, the pill insertion tool configured to be held by the user, and further configured to both maneuver one of the plurality of pills by the user and insert said one of the plurality of pills into the one of the plurality of individual storage units via its respective pill port, the pill insertion tool including an elongate member, a user interface at one end of the elongate member, and a pill interface at an opposite end of the elongate member, the pill interface sized and dimensioned to receive and hold at least a portion of the one of the plurality of pills during insertion into the one of the plurality of individual storage units via its respective pill port.

2. The apparatus of claim 1, wherein each chamber lid is labeled to indicate a day of a week.

3. The apparatus of claim 1, wherein the apparatus is configured to dispense at least one of the plurality of pills in the form of a capsule.

4. The apparatus of claim 1, wherein the apparatus is configured to dispense at least one of the plurality of pills in the form of a tablet.

5. The apparatus of claim 1, wherein the apparatus is configured to dispense at least one of the plurality of pills in the form of a gel tab.

6. The apparatus of claim 1, wherein the apparatus is configured to dispense at least one of the plurality of pills in the form of a gel cap.

7. The apparatus of claim 1, wherein the first sorting tray, the second sorting tray, the plurality of pill passageways, the at least one pillbox, and the pill insertion tool are made from at least one material selected from a group including plastic, ferrous material, nonferrous material, wood, and glass.

8. The apparatus of claim 1, wherein the at least one pillbox is at least semitransparent.

9. The apparatus of claim 1, wherein the first sorting tray and the second sorting tray are opaque.

10. The apparatus of claim 1, wherein each pill port is further configured to automatically close when one of the plurality of pills is not being inserted by the user.

11. The apparatus of claim 1, wherein the user interface of the pill insertion tool has a circular circumference about a longitudinal axis of the elongate member.

12. The apparatus of claim 11, wherein the user interface of the pill insertion tool has a polygonal circumference about a longitudinal axis of the elongate member.

13. The apparatus of claim 1, wherein the at least one pillbox includes indicia which indicates a time of day.

14. The apparatus of claim 13, wherein the indicia indicating the time of day is selected from a group including morning, AM, mid-morning, mid-day, noon, lunch, mid-afternoon, afternoon, late-afternoon, dinner, evening, night-time, bedtime, and PM.

15. The apparatus claim 13, wherein the at least one pillbox further includes indicia which indicates a time of a clock.

16. The apparatus of claim 13, wherein each of the plurality of pill passageways are labeled to indicate the day of the week corresponding with the day of the week of its respective chamber lid.

17. An apparatus for sorting, managing, and storing a plurality of pills, the apparatus comprising:

a first sorting tray, said first sorting tray configured for holding one or more of the plurality of pills, the first sorting tray including a first tray surface defining a first holding direction that is normal to the first tray surface, a first tray rim extending from the first tray surface in the first holding direction, and a first pill exit defined by a break in the first tray rim proximate the first tray surface, the first pill exit sized and dimensioned to permit at least one of the plurality of pills to be slid off the first tray surface when the first direction is oriented upward, a second sorting tray, said second sorting tray configured for holding one or more of the plurality of pills, the second sorting tray coupled to the first sorting tray, the second sorting tray including a second tray surface defining a second holding direction that is normal to the second tray surface and is opposite the first holding direction, a second tray rim extending from the second tray surface in the second holding direction, and a second pill exit defined by a break in the second tray rim proximate the second tray surface, the second pill exit sized and dimensioned to permit at least one of the plurality of pills to be slid off the second tray surface when the second direction is oriented upward, a plurality of pill passageways, each pill passageway passing through the first sorting tray surface and the second sorting tray surface, and configured to permit passage of one of the plurality of pills between the first sorting tray surface and the second sorting tray surface, at least one pillbox, said at least one pillbox configured to removably couple to the first sorting tray, and further configured to segregate and store the plurality of pills, the at least one pillbox including a plurality of individual storage units coupled together, each individual storage unit including a pill chamber, sized and dimensioned to hold at least one of the plurality of pills, the pill chamber having a chamber opening sized and dimensioned to provide a user with access to the pill chamber, a chamber lid coupled to the pill chamber and configured to close the chamber opening of the pill chamber, said chamber lid sharing a snap-fit interface with the pill chamber, and a pill port configured to align with one of the plurality of pill passageways when the pillbox is coupled to the first sorting tray, and further configured to individually receive one of the plurality of pills into the pill chamber via its respectively aligned pill passageway when inserted by the user, and to retain said one of the plurality of pills from exiting the pill chamber once inserted, and a pill insertion tool, the pill insertion tool configured to be held by the user, and further configured to both maneuver one of the plurality of pills by the user and insert said one of the plurality of pills into the one of the plurality of individual storage units via its respective pill port, the pill insertion tool including an elongate member, a user interface at one end of the elongate member, and a pill interface at an opposite end of the elongate member, the pill interface sized and dimensioned to receive and hold at least a portion of the one of the plurality of pills during insertion into the one of the plurality of individual storage units via its respective pill port;

wherein the apparatus is configured to dispense at least one of the plurality of pills in the form of a tablet;

wherein the at least one pillbox includes indicia which indicates a time of day;

wherein each chamber lid is labeled to indicate a day of a week;

wherein each of the plurality of pill passageways are labeled to indicate the day of the week corresponding with the day of the week of its respective chamber lid;

wherein the at least one pillbox is at least semitransparent;

wherein the first sorting tray and the second sorting tray are opaque;

wherein the user interface of the pill insertion tool has a circular circumference about a longitudinal axis of the elongate member.

18. A method of sorting, managing, and storing a plurality of pills, the method comprising the steps of:

providing an apparatus for sorting, managing, and storing the plurality of pills, the apparatus including:

a first sorting tray, said first sorting tray configured for holding one or more of the plurality of pills, the first sorting tray including a first tray surface defining a first holding direction that is normal to the first tray surface, a first tray rim extending from the first tray surface in the first holding direction, and a first pill exit defined by a break in the first tray rim proximate the first tray surface, the first pill exit sized and dimensioned to permit at least one of the plurality of pills to be slid off the first tray surface when the first direction is oriented upward, a second sorting tray, said second sorting tray configured for holding one or more of the plurality of pills, the second sorting tray coupled to the first sorting tray, the second sorting tray including a second tray surface defining a second holding direction that is normal to the second tray surface and is opposite the first holding direction, a second tray rim extending from the second tray surface in the second holding direction, and a second pill exit defined by a break in the second tray rim proximate the second tray surface, the second pill exit sized and dimensioned to permit at least one of the plurality of pills to be slid off the second tray surface when the second direction is oriented upward, a plurality of pill passageways, each pill passageway passing through the first sorting tray surface and the second sorting tray surface, and configured to permit passage of one of the plurality of pills between the first sorting tray surface and the second sorting tray surface, at least one pillbox, said at least one pillbox configured to removably couple to the first sorting tray, and further configured to segregate and store the plurality of pills, the at least one pillbox including a plurality of individual storage units coupled together, each individual storage unit including a pill chamber, sized and dimensioned to hold at least one of the plurality of pills, the pill chamber having a chamber opening sized and dimensioned to provide a user with access to the pill chamber, a chamber lid coupled to the pill chamber and configured to close the chamber opening of the pill chamber, said chamber lid sharing a snap-fit interface with the pill chamber, and a pill port configured to align with one of the plurality of pill passageways when the pillbox is coupled to the first sorting tray, and further configured to individually receive one of the plurality of pills into the pill chamber via its respectively aligned pill passageway when inserted by the user, and to retain said one of the plurality of pills from exiting the pill chamber once inserted, and a pill insertion tool, the pill insertion tool configured to be held by the user, and further configured to both maneuver one of the plurality of pills by the user and insert said one of the plurality of pills into the one of the plurality of individual storage units via its respective pill port, the pill insertion tool including an elongate member, a user interface at one end of the elongate member, and a pill interface at an opposite end of the elongate member, the pill interface sized and dimensioned to receive and hold at least a portion of the one of the plurality of pills during insertion into the one of the plurality of individual storage units via its respective pill port;

attaching one of the at least one pillbox to the second sorting tray;

turning the apparatus for sorting, managing, and storing the plurality of pills so that the first sorting tray is facing upward;

pouring the plurality of pills onto the first sorting tray;

gripping the pill insertion tool by the user interface so that the pill interface is in a distal orientation; and pushing each of the plurality of pills individually into and through one of the plurality of pill passageways and into one of the plurality of individual storage units of the at least one pillbox.

19. The method of claim 18, further comprising the steps of:

lifting the apparatus for sorting, managing, and storing the plurality of pills; and tipping the apparatus for sorting, managing, and storing the plurality of pills so that the remaining pills are poured through the first pill exit.

20. The method of claim 18, yet further comprising the steps of:

detaching the at least one pillbox from the second sorting tray;

opening the chamber lid of the pillbox; and dispensing the contents of the opened one of the plurality of individual storage units.

* * * * *